US011608650B2

(12) United States Patent
Smith et al.

(10) Patent No.: US 11,608,650 B2
(45) Date of Patent: Mar. 21, 2023

(54) RAILING SYSTEM

(71) Applicants: Brent Edward Smith, Weston, MO (US); Matthew Scott Small, Olathe, KS (US)

(72) Inventors: Brent Edward Smith, Weston, MO (US); Matthew Scott Small, Olathe, KS (US)

( * ) Notice: Subject to any disclaimer, the term of this patent is extended or adjusted under 35 U.S.C. 154(b) by 510 days.

(21) Appl. No.: 16/656,275

(22) Filed: Oct. 17, 2019

(65) Prior Publication Data

US 2020/0048920 A1 Feb. 13, 2020

Related U.S. Application Data

(62) Division of application No. 15/456,023, filed on Mar. 10, 2017, now abandoned.

(51) Int. Cl.

| | |
|---|---|
| ***E04H 17/22*** | (2006.01) |
| ***E04G 1/34*** | (2006.01) |
| ***E04G 21/32*** | (2006.01) |
| ***E04F 11/18*** | (2006.01) |

(52) U.S. Cl.

CPC ..... *E04G 21/3228* (2013.01); *E04F 11/1865* (2013.01); *E04G 1/34* (2013.01); *E04H 17/22* (2013.01); *Y10T 403/32401* (2015.01); *Y10T 403/32868* (2015.01)

(58) Field of Classification Search

CPC ..... E04H 17/22; E04G 1/34; E04G 21/3228; E05D 11/1007; E05D 11/1014; Y10T 403/32319; Y10T 403/32401; Y10T 403/32868; F16C 11/10

See application file for complete search history.

(56) References Cited

U.S. PATENT DOCUMENTS

| | | | | | |
|---|---|---|---|---|---|
| 1,039,986 | A * | 10/1912 | Merritt | 5/314.1 | |
| 4,131,378 | A * | 12/1978 | Daws | E05D 3/12 16/388 | |
| 4,611,945 | A * | 9/1986 | Diego | F16C 11/10 403/96 | |
| 6,565,069 | B2 * | 5/2003 | Morris | E04F 11/1836 256/73 | |
| 9,617,747 | B2 * | 4/2017 | Seto | E04G 21/3228 | |
| 10,100,564 | B2 * | 10/2018 | Lapchev | E05D 11/1014 | |

FOREIGN PATENT DOCUMENTS

| | | | | |
|---|---|---|---|---|
| GB | 2 442 326 | * | 4/2008 | E04G 1/34 |
| GB | 2472267 | * | 2/2011 | E04G 21/32 |

* cited by examiner

*Primary Examiner* — Michael P Ferguson
(74) *Attorney, Agent, or Firm* — Hovey Williams LLP

(57) ABSTRACT

A railing system having a number of spaced apart support bases and a railing is provided. The railing includes a number of vertically extending stanchions connected to the support bases and a number of horizontally extending members extending between the vertically extending stanchions. The railing is configured to be shifted relative to the support bases between a stored position and an erected position. The railing is automatically secured in the erected position when the railing is shifted from the stored position to the erected position.

8 Claims, 10 Drawing Sheets

RAILING SYSTEM

RELATED APPLICATIONS

This application is a divisional application, and claims priority benefit with regard to all common subject matter, of earlier-filed non-provisional U.S. patent application Ser. No. 15/456,023, filed on Mar. 10, 2017, and entitled "RAILING SYSTEM". The identified earlier-filed non-provisional patent application is hereby incorporated by reference in its entirety into the present application.

BACKGROUND

Embodiments of the present invention relate to safety railing systems.

Safety railing systems are used to prevent workers or other people from falling off of elevated surfaces or to prevent people from entering dangerous or restricted areas. Conventional safety railing systems may be permanent or temporary. Permanent railing systems are installed on site and are typically integrally mounted or constructed to the surface or area to be protected, which presents a number of drawbacks. For example, these railing systems must be designed and specified by a safety expert and a structural expert, who must coordinate with the building's architect for aesthetic considerations. This tremendously increases the building cost. Permanent railing systems also cannot be removed, which may reduce the building's aesthetic appeal. Temporary railing systems may be used instead of permanent railing systems, but they have drawbacks as well. For example, temporary railing systems must be installed before the protected area can be used or worked on. This is time consuming and costly. Also, temporary railing systems may be installed incorrectly by unskilled non-safety oriented workers. For example, fasteners may be secured incorrectly, incompletely, or not secured at all.

SUMMARY

A railing system that can be easily and quickly switched between stored and erected positions and automatically secured in the erected position is provided.

An embodiment of the present invention is a railing system having a number of spaced apart support bases and a railing. The railing includes a number of vertically extending stanchions connected to the support bases and a number of horizontally extending members extending between the vertically extending stanchions. The railing is configured to be shifted relative to the bases between a stored position and an erected position. The railing is automatically secured in the erected position when the railing is shifted from the stored position to the erected position.

Another embodiment of the present invention is a hinge for a railing system. The hinge includes a first section configured to be rigidly connected to a stanchion of a railing system and a second section configured to be rigidly connected to a support base of the railing system. The first section and the second section each include a base, a tab extending from the base, and an open-ended cavity extending into the base. The tabs of the first and second sections are connected to each other via a fastener extending through slots in the tabs. The tabs are configured to be inserted into the cavity of the opposing section so that the first and second sections are configured to pivot relative to each other when the tabs are not in the cavities and are not able to pivot relative to each other when the tabs are inserted into the cavities.

Another embodiment is a hinge similar to the hinge described above except that the lower section includes a backstop for preventing the hinge from pivoting in more than one direction from an inline configuration. That is, the backstop will prevent the hinge and hence the railing from pivoting beyond the intermediate or erected positions.

This summary is provided to introduce a selection of concepts in a simplified form that are further described in the detailed description below. The summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
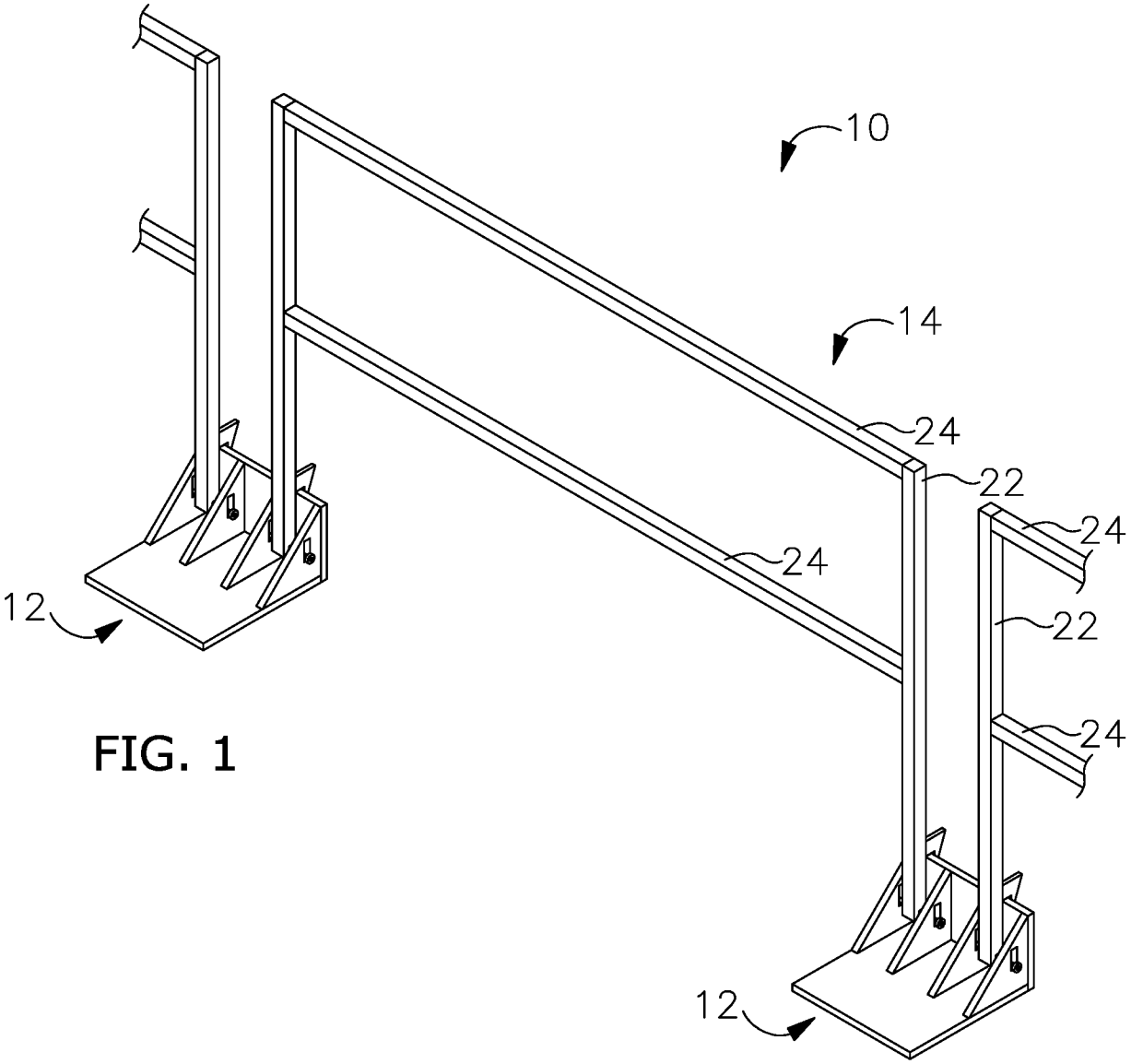
FIG. 1 is a perspective view of a railing system constructed in accordance with an embodiment of the present invention.
Figure 2:
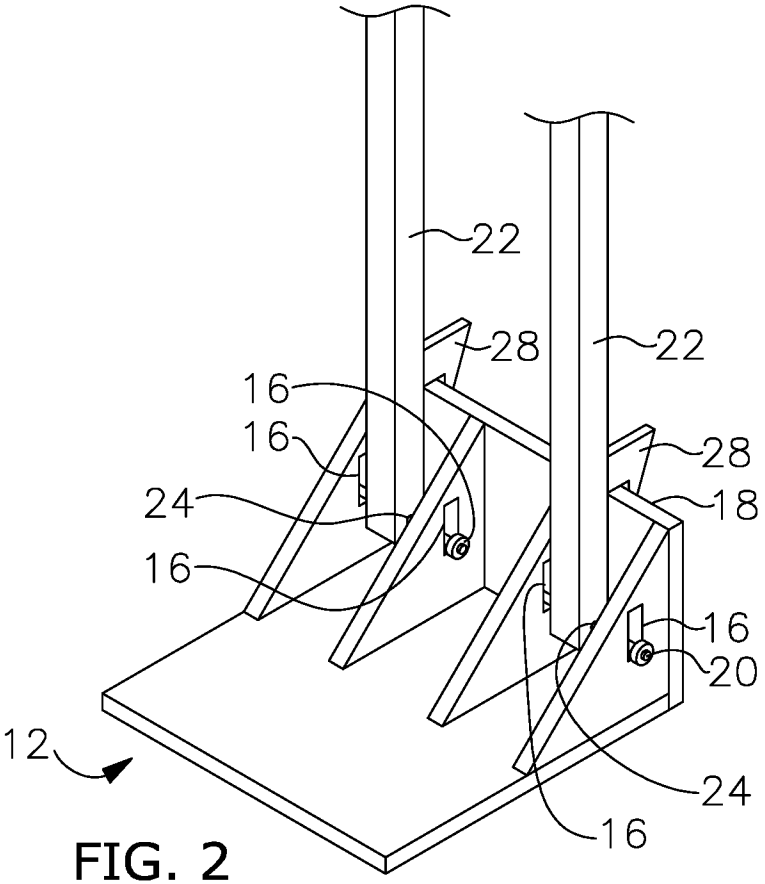
FIG. 2 is an enlarged perspective view of a railing and support base of the railing system of FIG. 1.
Figure 3:
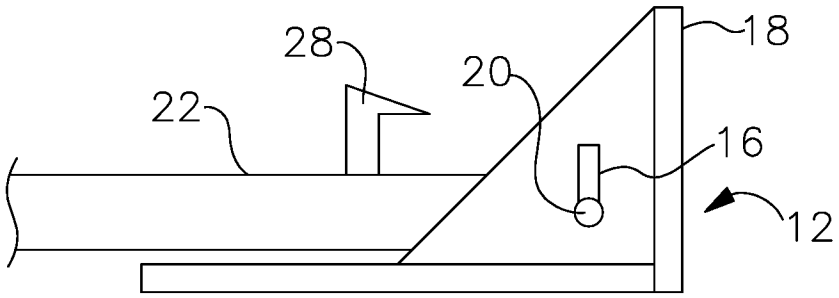
FIG. 3 is an elevation view of the railing and support base of FIG. 2, the railing being in a stored position.
Figure 4:
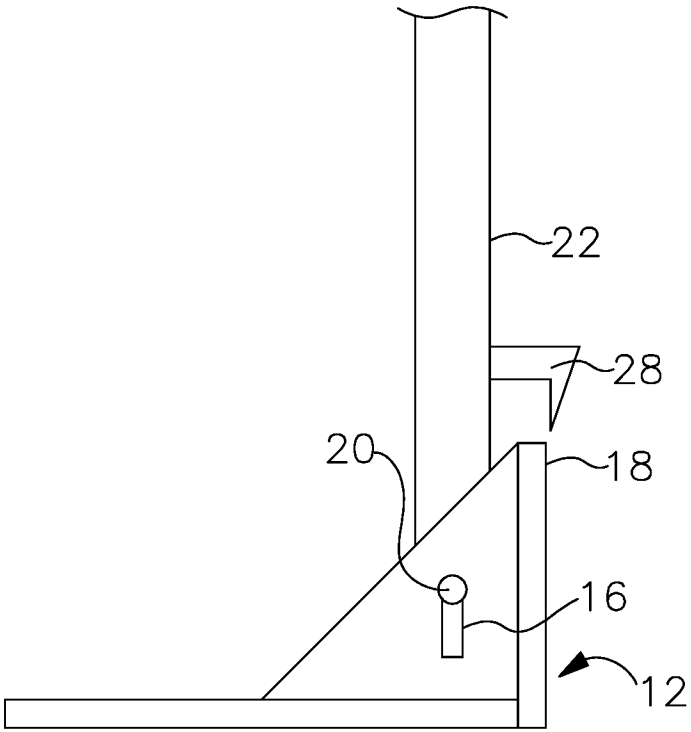
FIG. 4 is an elevation view of the railing and support base of FIG. 2, the railing being in an intermediate position.
Figure 5:
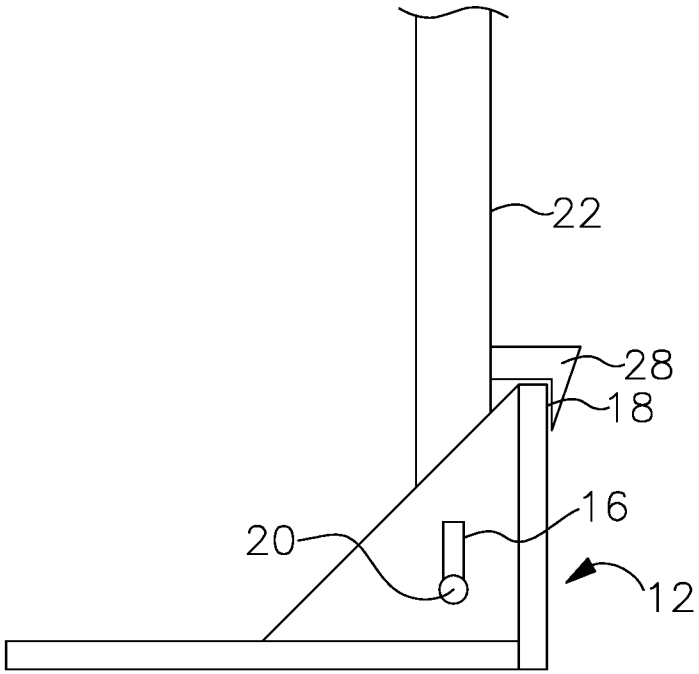
FIG. 5 is an elevation view of the railing and support base of FIG. 2, the railing being in an erected position.
Figure 6:
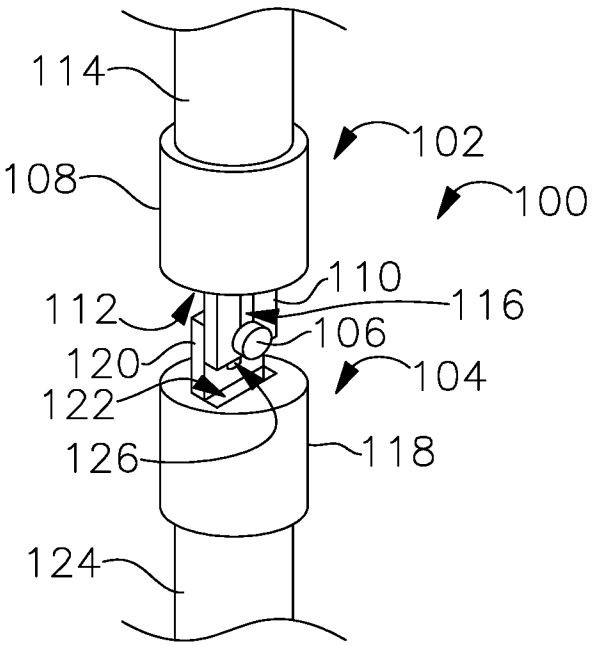
FIG. 6 is a perspective view of a hinge for a railing system hinge constructed in accordance with another embodiment of the present invention.
Figure 7:
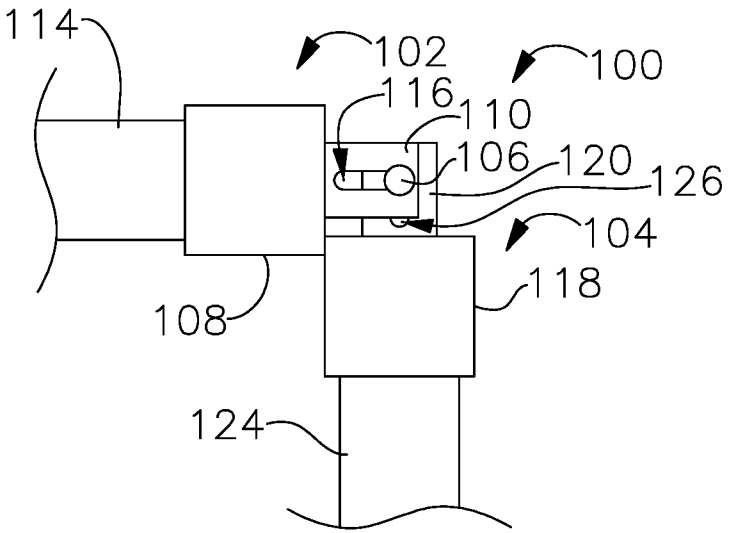
FIG. 7 is an elevation view of the hinge of FIG. 5, the hinge being in a stored position.
Figure 8:
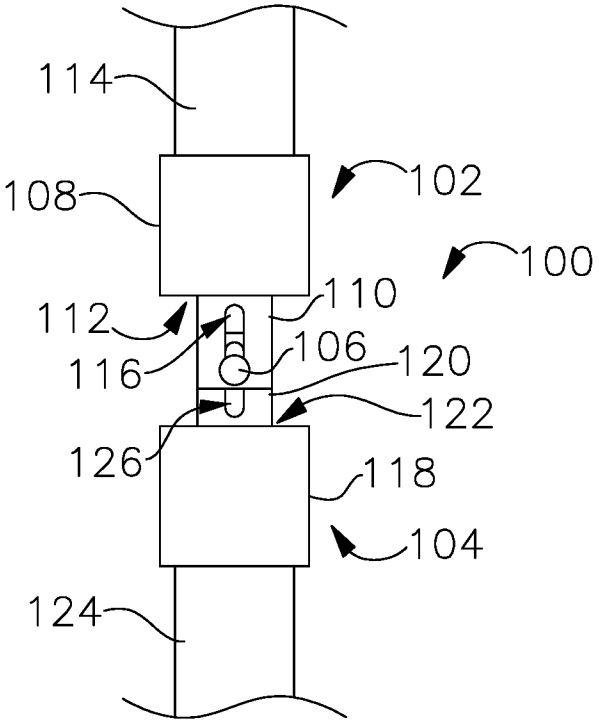
FIG. 8 is an elevation view of the hinge of FIG. 5, the hinge being in an intermediate position.
Figure 9:
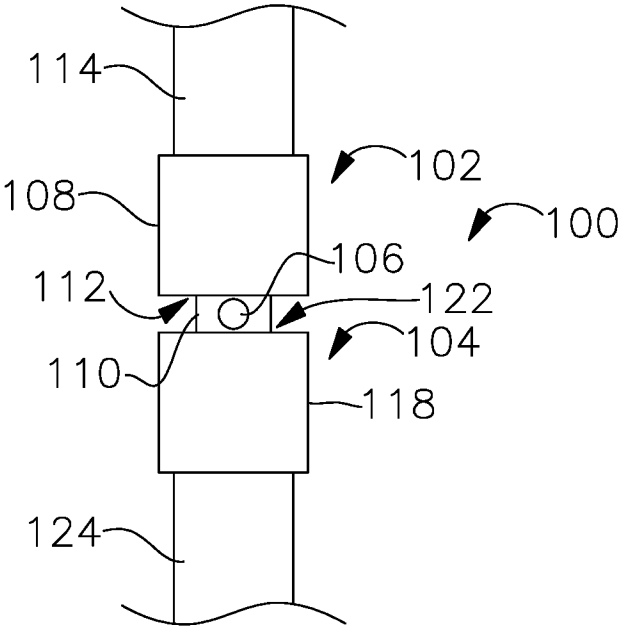
FIG. 9 is an elevation view of the hinge of FIG. 5, the hinge being in an erected position.

The drawing figures do not limit the current invention to the specific embodiments disclosed and described herein. The drawings are not necessarily to scale, emphasis instead being placed upon clearly illustrating the principles of the present invention.

DETAILED DESCRIPTION OF THE EMBODIMENTS

The following detailed description of the present invention references the accompanying drawings that illustrate specific embodiments in which the present invention can be practiced. The embodiments are intended to describe aspects of the present invention in sufficient detail to enable those skilled in the art to practice the present invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning to the drawing figures, and particularly FIGS. 1-5, a guardrail system 10 configured to be easily erected is illustrated. The guardrail system 10 broadly comprises a plurality of spaced apart support bases 12 and a plurality of railings 14.

The support bases 12 support the guardrail system 10 and each may include a vertically extending fastener slot 16 and a catch 18 for engaging a latch of the railings 14. The fastener slot 16 may receive a fastener 20 therethrough for connecting one or more railings 14 to the support base 12. The catch 18 may be a base wall, a tab, a protrusion, or other suitable geometry or member and may be formed of sheet metal, existing material of the support bases 12, or any other suitable material. The support bases 12 may be fastened to an elevated surface near an edge of the elevated surface or near a dangerous or off-limits area. The support bases 12 may instead be weighted such that a prohibitively large force would be required to inadvertently move or tip the guardrail system. The support bases 12 may also or alternatively be sufficiently wide or long to prevent inadvertent tipping or moving. The support bases 12 may be formed of sheet metal, tube metal, metal stock, wood, or any other suitable material.

The railings 14 prevent workers or passersby from traversing the guardrail system 10 and include a plurality of vertically extending stanchions 22 and a plurality of horizontally extending members 24. The stanchions 22 extend from the support bases 12 and provide vertical support to the horizontally extending members 24. The stanchions 22 each may include a fastener opening 26 and a latch 28 for engaging the catch 18 described above. The fastener opening 26 may receive the fastener 20 therethrough for connecting the railings 14 to one of the support bases 12. It will be understood that the support base 12 may include a fastener opening while the railing 14 includes a vertically extending fastener slot to achieve the same result. Essentially, the railings 14 and the support bases 12 have slotted connections therebetween, the purpose of which is described in more detail below. The latch 28 may include an angled front side or front edge for sliding against the catch 18, as described in more detail below. The latch 28 may be a tab, a protrusion, hook, or other suitable geometry or member. The stanchions 22 may be formed of cylindrical or square tube metal, wood, or any other suitable material. The horizontally extending members 24 extend between adjacent stanchions for preventing workers or passersby from traversing the guardrail system either intentionally or unintentionally. The horizontally extending members 24 may be removably or fixedly secured to the stanchions 22 via welding, fasteners, interlocking geometry, or any other suitable connection.

Each railing 14 is configured to be shifted between a stored position in which the railing 14 is lowered and an erected position in which the railing 14 is able to prevent workers or passersby from traversing the guardrail system 10. More specifically, each railing 14 may be shifted from the stored position to an intermediate position wherein the railing 14 is pivoted relative to the support base 12 about the fastener 20 or another pivot axis. The railing 14 may need to also be lifted (translated vertically) slightly into the intermediate position. Importantly, the latch 28 is clear of the catch 18 when the railing 14 is in the intermediate position. Once the railing 14 is in the intermediate position, the railing 14 may be automatically shifted from the intermediate position to the erected position via gravity. The latch 28 automatically engages the catch 18 when the railing 14 shifts from the intermediate position to the erected position. That is, the railing 14 is automatically secured in the erected position, which prevents the railing 14 from being inadvertently shifted from the erected position to the stored position.

The railing 14 may then be selectively shifted from the erected position to the intermediate position wherein the railing 14 is lifted (translated vertically) until the latch 28 is clear of the catch 18. The railing 14 may then be shifted from the intermediate position to the stored position wherein the railing 14 is pivoted relative to the support base 12 about the fastener 20 or another pivot axis.

The railings 14 may thus be shifted between the stored position and the erected position one at a time or two at a time. For example, adjacent railings may be erected at once wherein a worker pushes a left railing with his left hand and pushes a right railing adjacent to the left railing with his right hand. Similarly the adjacent railings may be lowered wherein the worker lifts the left railing with his left hand and lifts the right railing with his right hand. In some embodiments, however, each railing may need to be pushed or lifted near midpoints of the horizontally extending members 24 such that the stanchions are lifted and pivoted evenly.

The guardrail system 10 provides numerous advantages over conventional guardrail systems. For example, the guardrail system 10 may be easily erected by a single lifting or pushing motion on each railing. The guardrail system 10 does not require additional pins, locks, or other fasteners to be connected to the railings in order to secure the railings 14 in the erected position. This significantly reduces the number of workers and amount of time required to raise the railings. The possibility of securing components being lost, stolen, or damaged is also eliminated. The lack of additional pins, locks, or other fasteners also eliminates the possibility of the railing system being in the erected position without being secured. For example, a conventional guardrail system may be in an erected position and thus appear to be secured when in reality the securing pin is broken or has not been inserted, which could result in the railing inadvertently shifting to a stored position and making the entire area unsafe. In contrast, the guardrail system 10 is secured by virtue of being in the erected position, which increases safety.

Turning to FIGS. 6-9, another embodiment of the present invention is a hinge 100 for use in a railing system such as the railing system 10. The hinge 100 includes a first section 102, a second section 104, and a fastener 106. The first section 102 includes a first base 108, a first tab 110, and a first open-ended cavity 112. The first base 108 may be secured to a bottom of a vertically extending stanchion 114 and may be a plug configured to be inserted into or positioned on an open end of the vertically extending stanchion. The first tab 110 may extend from the first base 108 and may have a first slot 116 extending along a primary axis of the first section 102 for receiving the fastener 106 therethrough.

The first open-ended cavity 112 extends into the first base 108 and is offset from the first tab 110.

The second section 104 may be essentially similar or identical to the first section 102 and may have a second base 118, a second tab 120, and a second open-ended cavity 122. The second base 118 may be similar to the first base 108 except that the second base 118 may be secured on or in a support base or an anchor of a support base. For example, the second base 118 may be a plug configured to be inserted into an open-ended anchor 124. The second tab 120 extends from the second base 118 and may include a second slot 126 for receiving the fastener 106 therethrough. The second cavity 122 may be offset from the second tab 120.

The first section 102 and the second section 104 may be pivotably connected to each other via the fastener 106 such that a corresponding railing may be shifted between a stored position and an intermediate position. When the first section 102 and the second section 104 are axially aligned with each other (e.g., when a corresponding railing is shifted to an intermediate position), the second tab 120 may be inserted into the first cavity 122 of the first section 102 and the first tab 110 may be inserted into the second cavity 122 of the second section 104 such that the first section 102 and the second section 104 cannot pivot relative to each other. That is, the first section 102 may be translated towards the second section 104 (in a downward direction) into interlocking engagement with each other when the first section 102 and the second section 104 are axially aligned such that the railing is secured in an erected position. This translation may be automatic due to gravity when the corresponding railing reaches the intermediate position. The first section 102 may be translated away from the second section 104 (in an upward direction) such that the corresponding railing is shifted from the erected position to the intermediate position. Once the first tab 110 clears the second open-ended cavity 122 and the second tab 120 clears the first open-ended cavity 122 (that is, once the corresponding railing is in the intermediate position), the first section 102 and the second section 104 may again be pivoted relative to each other such that the corresponding railing is shifted from the intermediate position to the stored position.

The above-described hinge 100 simplifies design and manufacturing. For example, the first section 102 and the second section 104 may be identical to each other so that fewer parts need to be designed and manufactured. The hinge 100 is easily inserted into ends of stanchions and support bases, thus simplifying assembly. In some embodiments, the hinge 100 may conceal the pivoting mechanism, thus reducing the likelihood of tampering.

Figure 10:
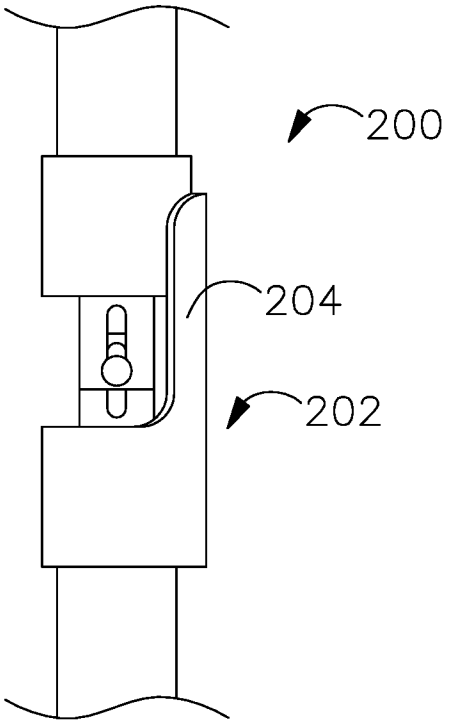
FIG. 10 is an elevation view of a hinge including a backstop.

Turning to FIG. 10, another embodiment is a hinge 200 similar to the hinge 100 described above except that the lower section 202 includes a backstop 204 for preventing the hinge 200 from pivoting in more than one direction from an inline configuration. That is, the backstop 204 will prevent the hinge 200 and hence the railing from pivoting beyond the intermediate or erected positions.

Although the present invention has been described with reference to the embodiments illustrated in the attached drawing figures, it is noted that equivalents may be employed and substitutions made herein without departing from the scope of the present invention as recited in the claims.

Having thus described various embodiments of the present invention, what is claimed as new and desired to be protected by Letters Patent includes the following:

1. A guardrail system comprising:

a plurality of spaced apart support bases each including a vertically extending anchor at least partially formed of tube metal; and a railing including:

a plurality of vertically extending stanchions connected to the support bases, the vertically extending stanchions being at least partially formed of tube metal; and a plurality of horizontally extending members extending between the plurality of vertically extending stanchions, the railing being configured to be shifted relative to the bases between a stored position and an erected position, each vertically extending stanchion and each vertically extending anchor including a hinge section positioned on or in a respective end thereof, each hinge section including a base portion affixed to a respective one of the stanchion and the anchor and a tab axially-extending from the base portion and having a slot configured to receive a fastener therethrough, the tabs of the hinge sections of the vertically extending stanchions being laterally offset from and parallel to the tabs of the hinge sections of the vertically extending anchors so that the slots of the hinge sections of the vertically extending stanchions align with the slots of the hinge sections of the vertically extending anchors such that the fasteners extend through the aligned slots and form links between the offset tabs thereby directly connecting the hinge sections of the vertically extending stanchions and the hinge sections of the vertically extending anchors together, the base portion of each hinge section of the vertically extending stanchions including an open-ended cavity configured to align with and receive a tab of a corresponding hinge section of one of the vertically extending anchors therein and the base portion of each hinge section of the vertically extending anchors including an open-ended cavity configured to align with and receive a tab of a corresponding hinge section of one of the vertically extending stanchions therein when the railing is shifted to the erected position and the base portions of the hinge sections are axially aligned with each other, the tab and open-ended cavity of each hinge section being laterally offset from each other.

2. The guardrail system of claim 1, wherein the railing is configured to be shifted from the erected position to the stored position only via an initial vertical force exerted on the railing.

3. The guardrail system of claim 1, wherein the railing is configured to automatically translate via gravity into the erected position from an intermediate position in which the vertically extending stanchions are oriented vertically.

4. The guardrail system of claim 1, wherein the hinge sections are identical to each other.

5. A guardrail and base assembly comprising:

a support base including a vertically extending anchor at least partially formed of tube metal; and a railing including a vertically extending stanchion connected to the support base, the vertically extending stanchion being at least partially formed of tube metal, the vertically extending stanchion being configured to be shifted relative to the base between a stored position and an erected position, each of the vertically extending stanchion and the vertically extending anchor including a hinge section positioned on or in a respective end thereof, each hinge section including a base portion affixed to a respective one of the stanchion and the anchor and a tab axially-extending from the base portion and having a slot configured to receive a fastener therethrough, the tab of the hinge section of the vertically extending stanchion being laterally offset from and parallel to the tab of the hinge section of the vertically extending anchor so that the slot of the hinge section of the vertically extending stanchion aligns with the slot of the hinge section of the vertically extending anchor such that the fastener extends through the aligned slots and forms a link between the offset tabs thereby directly connecting the hinge section of the vertically extending stanchion and the hinge section of the vertically extending anchor together, the base portion of the hinge section of the vertically extending stanchion including an open-ended cavity configured to align with and receive the tab of the hinge section of the vertically extending anchor therein and the base portion of the hinge section of the vertically extending anchor including an open-ended cavity configured to align with and receive the tab of the hinge section of the vertically extending stanchion therein when the vertically extending stanchion is shifted to the erected position and the base portions of the hinge sections are axially aligned with each other, the tab and open-ended cavity of each hinge section being laterally offset from each other.

6. The guardrail and base assembly of claim 5, wherein the vertically extending stanchion is configured to be shifted from the erected position to the stored position only via an initial vertical force exerted on the vertically extending stanchion.

7. The guardrail and base assembly of claim 5, wherein the vertically extending stanchion is configured to automatically translate via gravity into the erected position from an intermediate position in which the vertically extending stanchion is oriented vertically.

8. The guardrail and base assembly of claim 5, wherein the hinge sections are identical to each other.

* * * * *